US012366256B2

(12) United States Patent
Owen-Block et al.

(10) Patent No.: US 12,366,256 B2
(45) Date of Patent: Jul. 22, 2025

(54) SYSTEMS AND METHODS ASSOCIATED WITH SOUND DAMPENING IN BLOWERS

(71) Applicant: Milwaukee Electric Tool Corporation, Brookfield, WI (US)

(72) Inventors: Benjamin J. Owen-Block, St. Cloud, MN (US); Ryan Edward McKernan, Green Oaks, IL (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 18/503,516

(22) Filed: Nov. 7, 2023

(65) Prior Publication Data

US 2024/0159249 A1 May 16, 2024

Related U.S. Application Data

(60) Provisional application No. 63/424,304, filed on Nov. 10, 2022.

(51) Int. Cl.
*F04D 29/66* (2006.01)
*F04D 19/00* (2006.01)

(52) U.S. Cl.
CPC ..... *F04D 29/663* (2013.01); *F04D 19/002* (2013.01)

(58) Field of Classification Search
CPC ..... F04D 29/663; F04D 19/002
See application file for complete search history.

(56) References Cited

U.S. PATENT DOCUMENTS

| | | | | |
|---|---|---|---|---|
| 4,596,921 | A * | 6/1986 | Hersh | A45D 20/10 392/385 |
| 6,158,082 | A * | 12/2000 | Beckey | A47L 9/0081 181/252 |
| 6,575,695 | B1 * | 6/2003 | Miyamoto | B05B 7/1427 415/206 |
| 6,715,842 | B1 * | 4/2004 | Bopp | B60C 19/002 301/6.91 |
| 10,117,491 | B2 * | 11/2018 | Moloney | F24H 3/0423 |
| 2016/0235178 | A1 * | 8/2016 | Atkinson | A45D 20/50 |
| 2021/0219503 | A1 * | 7/2021 | Olvera | A47L 9/2842 |
| 2021/0396248 | A1 * | 12/2021 | Gao | F04D 29/667 |
| 2022/0010813 | A1 * | 1/2022 | Sugawara | G10K 11/172 |
| 2022/0025906 | A1 * | 1/2022 | Ji | F04D 29/664 |
| 2022/0080817 | A1 * | 3/2022 | Okano | B60J 10/75 |
| 2022/0089027 | A1 * | 3/2022 | Fong | B60K 35/60 |
| 2022/0160195 | A1 * | 5/2022 | Iwakami | A47L 9/0081 |
| 2022/0389939 | A1 * | 12/2022 | Hakuta | B64C 39/024 |
| 2023/0213009 | A1 * | 7/2023 | Feld | F02M 35/1211 181/229 |

* cited by examiner

*Primary Examiner* — Aaron R Eastman
(74) *Attorney, Agent, or Firm* — Dority & Manning, P.A.

(57) ABSTRACT

Systems and methods associated with sound dampening in blowers are provided. A blower including an air inlet; an air outlet; a conduit extending between the air inlet and the air outlet, the conduit defining a fan location and a fan stator disposed in series with the fan location, the fan stator defining at least one stator blade; and an axial fan disposed at the fan location, the axial fan defining at least one blade, wherein the conduit is coated with a first flocking at the fan location, wherein the at least one stator blade is coated with a second flocking, or both.

20 Claims, 3 Drawing Sheets

SYSTEMS AND METHODS ASSOCIATED WITH SOUND DAMPENING IN BLOWERS

PRIORITY STATEMENT

The present application claims the benefit of priority to U.S. Provisional Patent Application Ser. No. 63/424,304, filed on Nov. 10, 2022, the disclosure of which is incorporated by reference in its entirety.

FIELD

The present disclosure relates generally to sound dampening systems, and more particularly to sound dampening systems for blowers.

BACKGROUND

Blowers are generally utilized to create air pressure and generate airflow for yard work and debris clearing. Because blowers utilize high-speed moving fans to generate airflow, they invariably create noise. As consumers continue to demand improved tools, noise control is of increasing importance and consideration.

Accordingly, improved sound dampening systems are desired in the art. In particular, blowers with sound dampening characteristics would be advantageous.

BRIEF DESCRIPTION

Aspects and advantages of the invention in accordance with the present disclosure will be set forth in part in the following description, or may be obvious from the description, or may be learned through practice of the technology.

In accordance with one embodiment, a blower is provided. The blower includes an air inlet; an air outlet; an inlet bell disposed between the air inlet and the air outlet; an axial fan disposed at least partially within the inlet bell; and a fan stator disposed in series with the axial fan; wherein: the inlet bell comprises a first flocking disposed along an inner surface of the inlet bell at a location adjacent to a blade tip of the axial fan, wherein the at least one stator blade comprises a second flocking disposed along an exposed surface of the at least one stator blade, or both In accordance with another embodiment, a conduit for a blower is provided. The conduit includes an inlet bell; and a flocking disposed along at least a majority of an inner surface of the inlet bell.

In accordance with another embodiment, a method of sound dampening a blower is provided. The method includes applying a flocking to an inlet bell of the blower; and coupling the inlet bell to one or more other components of the blower.

These and other features, aspects and advantages of the present invention will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present invention, including the best mode of making and using the present systems and methods, directed to one of ordinary skill in the art, is set forth in the specification, which makes reference to the appended figures, in which.

DETAILED DESCRIPTION

Figure 1:
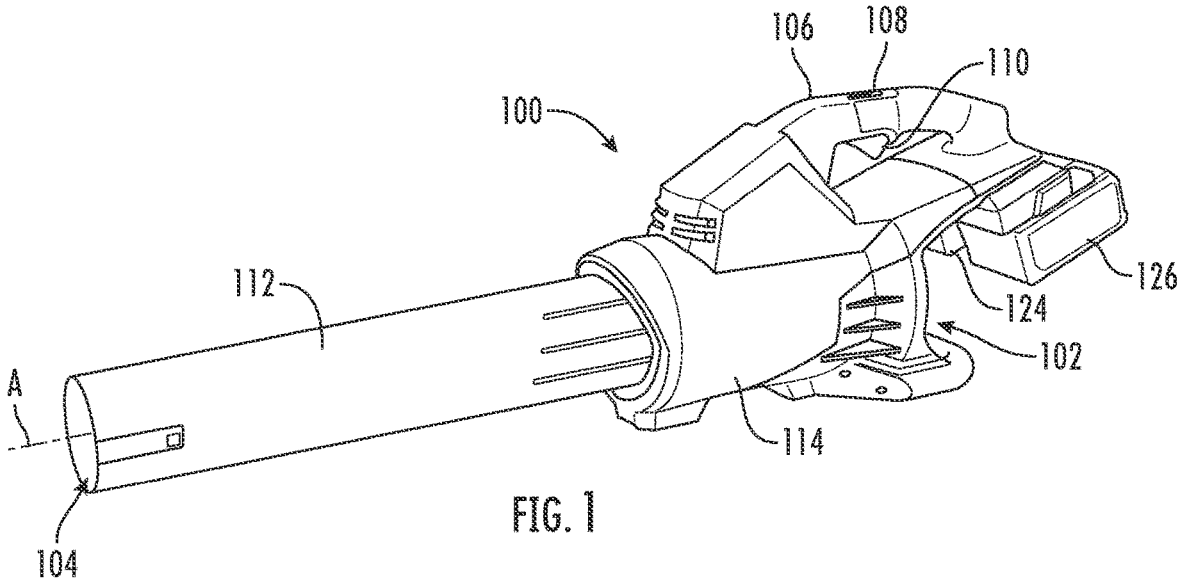
FIG. 1 is a perspective view of a blower in accordance with an exemplary embodiment of the present disclosure.

Reference now will be made in detail to embodiments of the present invention, one or more examples of which are illustrated in the drawings. The word "exemplary" is used herein to mean "serving as an example, instance, or illustration." Any implementation described herein as "exemplary" is not necessarily to be construed as preferred or advantageous over other implementations. Moreover, each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents. The detailed description uses numerical and letter designations to refer to features in the drawings. Like or similar designations in the drawings and description have been used to refer to like or similar parts of the invention.

As used herein, the terms "first", "second", and "third" may be used interchangeably to distinguish one component from another and are not intended to signify location or importance of the individual components. The singular forms "a," "an," and "the" include plural references unless the context clearly dictates otherwise. The terms "coupled," "fixed," "attached to," and the like refer to both direct coupling, fixing, or attaching, as well as indirect coupling, fixing, or attaching through one or more intermediate components or features, unless otherwise specified herein. As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features hut may include other features not expressly listed or inherent to such process, method, article, or apparatus. Further, unless expressly stated to the contrary, "or" refers to an inclusive- or and not to an exclusive- or. For example, a condition A or B is satisfied by any one of the following: A is true (or present) and B is false (or not present), A is false (or not present) and B is true (or present), and both A and B are true (or present).

Terms of approximation, such as "about," "generally," "approximately," or "substantially," include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Benefits, other advantages, and solutions to problems are described below with regard to specific embodiments. However, the benefits, advantages, solutions to problems, and any feature(s) that may cause any benefit, advantage, or solution to occur or become more pronounced are not to be construed as a critical, required, or essential feature of any or all the claims.

In general, a sound dampening system in accordance with one or more embodiments described herein may generally include a flocking applied along an inlet bell of a blower. The flocking can include, for example, loose fibers, which are adhered to an inner surface of the inlet bell. The loose fibers may be held in place by an adhesive applied along the inlet bell. In some instances, the flocking can be pre-attached to the adhesive. For example, the adhesive can include an adhesive backing with the loose fibers coupled therewith. In other instances, the flocking can be attached to the adhesive in situ, i.e., at the inner surface of the inlet bell. Without wishing to be bound by any particular theory, it is believed that the flocking described herein can reduce noise emissions from the blower.

Referring now to the drawings, FIG. 1 illustrates a perspective view of a blower 100 in accordance with an exemplary embodiment. The blower 100 is configured to generate airflow along an airflow conduit extending between an air inlet 102 and an air outlet 104 of the blower 100. An operator can control the blower 100 from a handle 106. The handle 106 can include, for example, a power button 108 switchable between ON and OFF states, a speed controller 110, and the like.

The blower 100 may define a central axis A extending between the air inlet 102 and the air outlet 104. An outlet tube 112 can extend parallel with the central axis A. In an embodiment, the handle 106 includes a graspable portion which lies along a best fit line offset from the central axis A by no more than 10 degrees. The handle 106 can be integral with a housing 114 of the blower 100.

Figure 2:
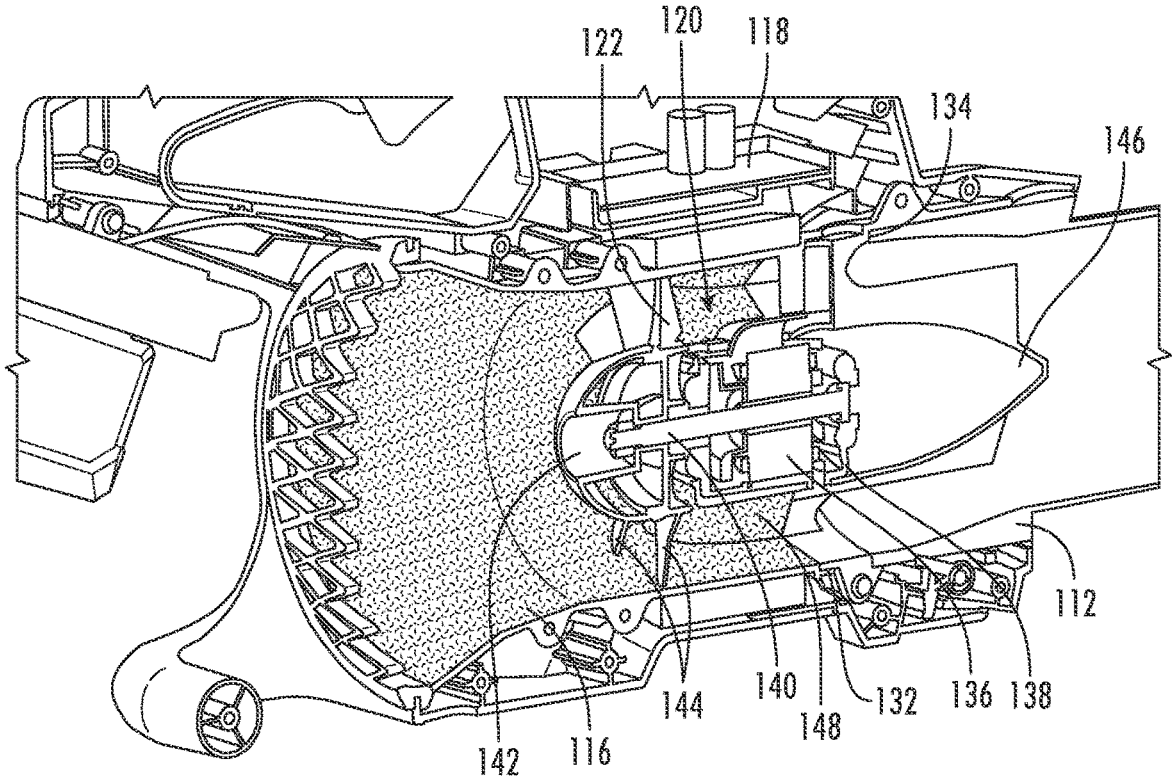
FIG. 2 is a cross-sectional view of the blower as seen along a central axis of the blower in accordance with an exemplary embodiment of the present disclosure.

FIG. 2 is a cross-sectional side view of the blower 100 as seen along the central axis A. As illustrated in FIG. 2, the housing 114 at least partially encloses components of the blower 100 such as an inlet bell 116, electronics 118, an axial fan assembly 120 including one or more axial fans 122, as well as various other components. Power to operate the axial fan assembly 120 can be provided by one or more batteries, such as batteries 124 and 126 (FIG. 1). As depicted, the batteries 124 and 126 may be located behind the handle 106 and upstream of the air inlet 102.

The inlet bell 116 depicted in FIG. 2 is formed from a single piece construction. In other embodiments, the inlet bell 116 can have a multi-piece construction made from, e.g., two or more body components coupled together to form the inlet bell 116. For example, the inlet bell 116 can include two similarly shaped halves which join together to form a tube-like cylindrical body.

Figure 3:
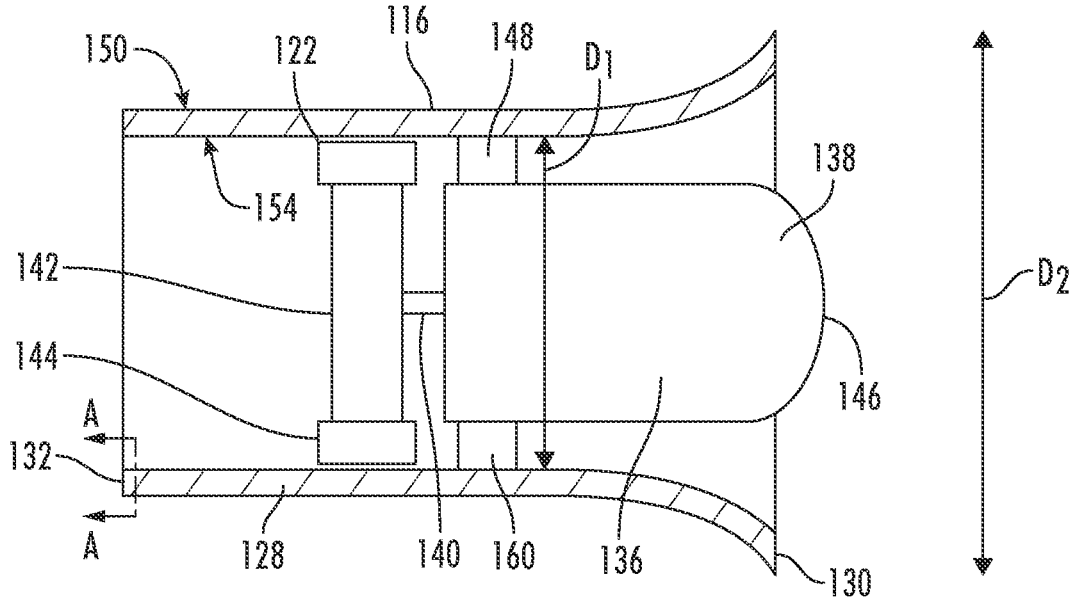
FIG. 3 is a schematic cross-sectional view of a conduit of the blower in accordance with an exemplary embodiment of the present disclosure.

Referring to FIG. 3, the inlet bell 116 can include a body 128 extending between an inlet bell upstream end 130 and an inlet bell downstream end 132. Airflow can pass through the body 128 in a direction from the inlet bell upstream end 130 to the inlet bell downstream end 132. The inlet bell downstream end 132 of the body 128 can have a generally cylindrical shape. The inlet bell upstream end 130 of the body 128 can have a bell shape. The bell shape can include one or more tapered sidewalls which define a first diameter $D_1$, as measured at a neck portion of the bell shape, and a second diameter $D_2$, as measured at the most flared portion of the bell shape. $D_2$ is greater than $D_1$, such as at least 1.01 $D_1$, such as at least 1.05 $D_1$, such as at least 1.1 $D_1$, such as at least 1.2 $D_1$, such as at least 1.5 $D_1$. In some instances, the bell shape can uniformly taper between $D_1$ and $D_2$, i.e., linearly taper. In other instances, the bell shape can taper at a variable, e.g., exponential, rate.

As shown in FIG. 2, an upstream end 134 of the outlet tube 112 can be disposed near the inlet bell downstream end 132. In an embodiment, the upstream end 134 of the outlet tube 112 and the inlet bell downstream end 132 can be spaced apart from one another in a direction along the central axis A (FIG. 1). In another embodiment, the upstream end 134 of the outlet tube 112 and the inlet bell downstream end 132 can be immediately adjacent to one another when the outlet tube 112 is properly installed on the blower 100. Airflow entering the blower 100 at the air inlet 102 can pass through the inlet bell 116 and outlet tube 112 before discharging through the air outlet 104.

The axial fan assembly 120 includes one or more axial fans 122. For instance, the axial fan assembly 120 can include a single axial fan 122 disposed in the path of airflow through the blower 100, two axial fans 122 disposed in the path of airflow through the blower 100, or three axial fans 122 disposed in the path of airflow through the blower 100. The axial fans 122 can be stacked to form a serial axial fan assembly 120.

In the depicted embodiment, the axial fan assembly 120 includes a single axial fan 122. The axial fan assembly 120 can include at least one motor 136, such as a DC motor, disposed in a motor housing 138. The motor 136 can provide power to a motor output shaft 140 to rotate the axial fan 122. The motor 136 can be controlled by the electronics 118 in view of one or more user inputs.

The axial fan 122 can include a central hub 142 and a plurality of blades 144 extending from the central hub 142. The central hub 142 is coupled to the motor output shaft 140. As the motor output shaft 140 rotates, the blades 144 propel airflow through the blower 100 from the air inlet 102 to the air outlet 104.

As depicted in FIG. 3, in accordance with an embodiment, the axial fan assembly 120, or a portion thereof, can be disposed at least partially within a volume defined by the inlet bell 116. Where the inlet bell 116 includes open surfaces, the volume can be defined by a best fit surface connecting the open edges of the inlet bell 116. In the depicted example, the best fit surfaces are planar and extend along rims of each of the cylindrical and flared ends of the inlet bell 116. In a more particular embodiment, the axial fan 122 can be disposed at least partially within the volume of the inlet bell 116. In yet a more particular embodiment, the entire axial fan 122 can be disposed within the volume defined by the inlet bell 116. In an embodiment, the motor output shaft 140 can have an exposed length, as measured by an exposed portion of the motor output shaft 140 between the motor housing 138 and the axial fan 122, that is disposed at least partially within, such as fully within, the volume defined by the inlet bell 116. In an embodiment, the motor 136 can be disposed at least partially within the volume defined by the inlet bell 116.

In an embodiment, the axial fan assembly 120 is a rear-fan assembly, wherein the axial fan 122 is disposed upstream of the motor 136. The axial fan 122 can be disposed centrally within the inlet bell 116. In a particular embodiment, the motor 136 can be positioned forward of the axial fan 122 and a majority of the motor 136 can be disposed within the volume defined by the inlet bell 116. A front end 146 of the motor housing 138 may extend beyond the inlet bell upstream end 130 of the body 128.

In an embodiment, the blower 100 can further include a stator 148 which is disposed in series with the axial fan 122 and reduces swirl in the airflow associated with rotation of the axial fan 122. The stator 148 can include one or more airflow features configured to reduce swirl. For example, the stator 148 can include a plurality of air-deflecting, stationary surfaces which are shaped and angled to impart straightening characteristics to the airflow. The air-deflecting, stationary surfaces can be spaced apart from each other around the motor 136 to impart similar characteristics to the airflow pattern across the entire circumferential area of the blower's airflow distribution.

The stator 148 is disposed on a downstream side of the axial fan 122. The stator 148 can extend from a side surface of the airflow path radially inward towards the motor 136. In some instances, the stator 148 can be coupled to the motor housing 138. In other instances, the stator 148 may not attach to the motor housing 138. In some instances, the stator 148 can be coupled to an outside wall of the airflow path, such as at the inlet bell 116, the outlet tube 112, or to the housing 114 or some other internal blower structure. In other instances, the stator 148 may not attach to the outside wall of the airflow path.

Figure 4:
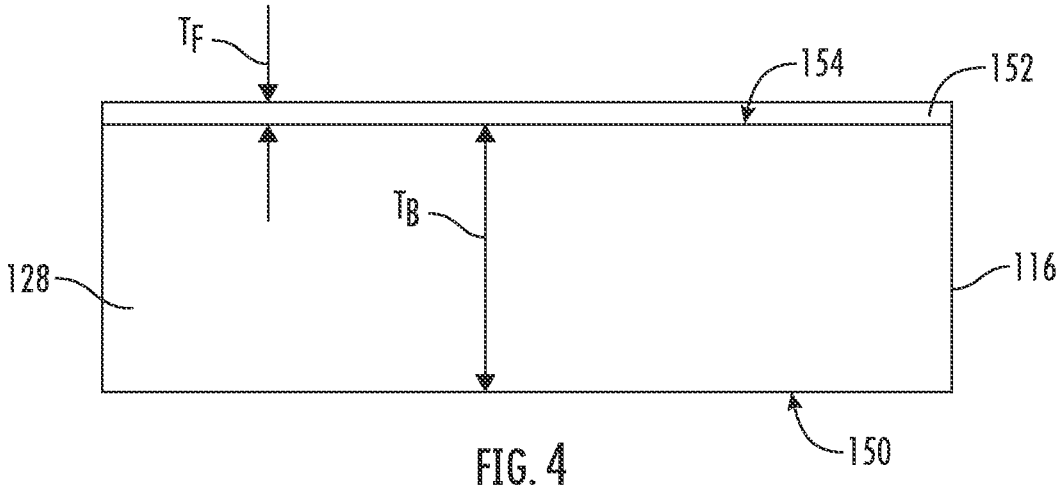
FIG. 4 is an enlarged cross-sectional view as seen along Line A-A in FIG. 3 in accordance with an exemplary embodiment of the present disclosure.

FIG. 4 illustrates a cross-sectional view of a portion of the inlet bell 116 as seen along Line A-A in FIG. 3. As depicted, the inlet bell 116 includes the body 128 which defines an outer surface 150 of the inlet bell 116 and a flocking 152 disposed on an inner surface 154 of the inlet bell 116.

The flocking 152 can be disposed along the body 128 of the inlet bell 116 and cover at least a majority of the inner surface 154. The flocking 152 can be coupled to the inner surface 154. For example, the flocking 152 can be adhered to the inner surface 154 or fastened to the inner surface 154 (e.g., using pins, rivets, threaded fasteners, non-threaded fasteners, or the like). The flocking 152 can cover at least 51% of the inner surface 154 of the inlet bell 116, such as at least 55% of the inner surface 154, such as at least 60% of the inner surface 154, such as at least 70% of the inner surface 154, such as at least 80% of the inner surface 154, such as at least 90% of the inner surface 154, such as at least 95% of the inner surface 154, such as at least 99% of the inner surface 154. In a particular embodiment, the flocking 152 covers the entire inner surface 154 of the inlet bell 116. In certain instances, the flocking 152 may extend over at least one of the inlet bell upstream end 130 and the inlet bell downstream end 132. That is, the flocking 152 can wrap around the inlet bell 116 to at least extend along the end surfaces of the inlet bell 116. In other instances, the flocking 152 can terminate on the inner surface 154.

In an embodiment, the flocking 152 extends continuously between the inlet bell upstream end 130 and the inlet bell downstream end 132 of the inlet bell 116. That is, the flocking 152 may be disposed along an uninterrupted path between the inlet bell upstream end 130 and the inlet bell downstream end 132 of the inlet bell 116. In a more particular embodiment, the flocking 152 can extend continuously between the inlet bell upstream end 130 and the inlet bell downstream end 132 along the entire circumference of the inner surface 154 of the inlet bell 116. As used herein, continuous flocking refers to a generally continuous distribution of flocking material disposed along the inner surface 154. However, it should be understood that certain application processes may include small gaps between individual components, e.g., fibers, of the flocking 152. That is, continuous flocking can include instances, for example, where the relative density of the flocking 152 is less than a maximum possible amount. Moreover, the flocking 152 can have a non-uniform flocking distribution including, for example, a bimodal distribution (e.g., two areas of the inner surface 154 include different relative flocking densities), a trimodal distribution (e.g., three areas of the inner surface 154 include different relative flocking densities), or another multi-modal distribution. By way of non-limiting example, the flocking 152 can be denser or taller at locations immediately adjacent to the axial fan 122, e.g., upstream and downstream of the axial fan 122. Changes in flocking density along the inner surface 154 of the inlet bell 116 may occur linearly, progressively, or at another different variable rate.

The flocking 152 can define a thickness $T_F$, as measured by an average thickness of the flocking 152, that is less than a thickness $T_B$ of the body 128 of the inlet bell 116. A thickness ratio of $T_F$ to $T_B$ $[T_F/T_B]$ can be less than 0.99, such as less than 0.95, such as less than 0.9. In an embodiment, the thickness ratio $[T_F/T_B]$ is less than 0.5, such as less than 0.25. In yet a more particular embodiment, the thickness ratio $[T_F/T_B]$ is less than 0.1, such as less than 0.05.

In an embodiment, the flocking thickness $T_F$ is in a range between 0.1 mm and 10 mm, such as in a range between 0.25 mm and 3 mm. By way of non-limiting example, $T_F$ can be approximately 0.25 mm, approximately 0.5 mm, approximately 1 mm, or approximately 2 mm.

An adhesive layer can be disposed between the flocking 152 and the body 128 of the inlet bell 116. The adhesive layer can include, for example, an adhesive strip comprising a backing and an adhesive layer disposed on the backing. The flocking 152 can be coupled to the backing which can be coupled to the body 128 to secure the flocking 152 to the body 128. In some instances, the adhesive layer can be pre-attached with the flocking 152 prior to coupling the flocking 152 to the body 128. In other instances, the adhesive layer can include a discrete layer which is separately attached to the body 128 and the flocking 152.

The flocking 152 generally includes a sound dampening material which, when positioned in the inlet bell 116, reduce sound emissions from the blower 100. By way of non-limiting example, the flocking 152 can include a cloth material, a felt material, or another stranded, woven, or other fabric-, polymer, or fibrous-based material. Yet other materials may be suitable. In some instances, the flocking 152 can take the form of a material sheet installed within the inlet bell 116. For example, the flocking 152 can be part of an adhesive backed tape applied along the inlet bell 116. The adhesive backed tape may be wrapped around the bell circularly, in lengthwise strips between the inlet bell upstream end 130 and the inlet bell downstream end 132, or as a single piece which spans the entire inner surface 154. In other instances, the flocking 152 can include loose fibers which are positioned at and retained along the inner surface 154 of the inlet bell 116 by, e.g., a pre-applied adhesive.

In some instances, the flocking 152 is positioned along the body 128 of the inlet bell 116 using a loose fiber application technique. For example, the inner surface 154 of the inlet bell 116 can be covered in adhesive which receives and retains blown flocking. The blown flocking can be introduced to the inner surface 154 using a loose fiber process such as, e.g., pressure application (for example, blowing loose fiber flocking into the inlet bell 116 under pressure or under the influence of air current), deposition (for example, electrostatic deposition), or the like.

Figure 5:
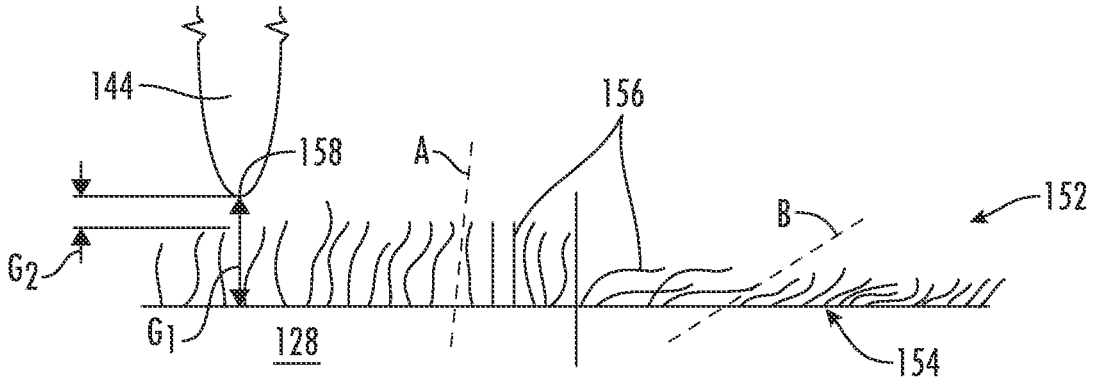
FIG. 5 is an enlarged cross-sectional view as seen along Line A-A in FIG. 3 in accordance with an exemplary embodiment of the present disclosure.

FIG. 5 illustrates an enlarged cross-sectional side view of the flocking 152 as seen on the body 128. On the left side, the flocking 152 is shown as loose fibers 156 as seen when the flocking 152 is initially installed, i.e., prior to at least the initial operation of the blower 100. During operation of the blower 100, the flocking 152 may deform. On the right side of FIG. 5, the flocking 152 is shown as loose fibers 156 as seen when the flocking 152 is experiencing airflow through the blower. The flocking 152 may remain in the deformed state as depicted on the right even after the blower 100 is stopped, i.e., airflow through the blower 100 terminates. In some instances, the flocking 152 may rebound at least partially to the state as shown on the left. That is, the flocking 152 can retain memory of one or more desired positions, configurations, or the like.

The average angle of the flocking 152, as measured with respect to the central axis A (FIG. 1) of the blower 100, is shown before the first use of the blower by dashed line A. The average angle of the flocking 152, as measured with respect to the central axis A of the blower 100, is shown after the first use of the blower by dashed line B. The angle of line A, as measured relative to the central axis A, is greater than the angle of line B.

Each blade 144 of the axial fan 122 can define a blade tip 158 spaced apart from the inner surface 154 of the inlet bell 116 by a first blade tip gap $G_1$. Each blade tip 158 can be spaced apart from a nearest, innermost location of the flocking 152 by a second blade tip gap $G_2$. $G_2$ may be measured either when the flocking is in the undeformed, i.e., unused, state or in the deformed, i.e., in-use or immediately after use, state. In an embodiment, $G_1$ can be at least 1.01 $G_2$, such as at least 1.1 $G_2$, such as at least 1.15 $G_2$, such as at least 1.2 $G_2$, such as at least 1.25 $G_2$, such as at least 1.3 $G_2$, such as at least 1.35 $G_2$, such as at least 1.4 $G_2$, such as at least 1.45 $G_2$, such as at least 1.5 $G_2$, such as at least 1.75 $G_2$, such as at least 2 $G_2$. In an embodiment, $G_2$ is less than 5 mm, such as less than 4 mm, such as less than 3 mm, such as less than 2 mm, such as less than 1 mm. In an embodiment, $G_2$ is less than 0.5 mm, such as less than 0.25 mm. In a particular embodiment, $G_2$ is less than 0.1 mm. Close proximity between the blade tips 158 and the flocking 152 can reduce noise generation of the blower 100 which is not otherwise possible with other types of materials and housings surrounding the axial fan 122 as the flocking 152 can better conform to the shape and pressure profile of the airflow passing through the conduit of the blower 100 and more precisely fit the axial fan 122. For instance, the flocking 152 can deform (naturally or in an engineered manner) to form a more suitable gap around the blade tips 158. This type of deformable gap can better accept tolerances and misalignments between the axial fan 122 and the inlet bell 116 consistently along the entire circumference of the axial fan 122 and with greater precision than any previous blower 100 has been able to achieve.

Referring again to FIG. 3, in some instances, the stator 148 can further include a flocking 160. The flocking 160 may be similar or different as compared to the flocking 152. For example, the flocking 160 can be formed from loose fiber material applied to the exposed surface of the stator 148. In certain instances, the flocking 160 is applied at the same time as the flocking 152. In other instances, the flocking 160 is applied at a different time as compared to the application of flocking 152 along the inner surface 154. In some instances, the flocking 160 is applied in situ with the stator 148 in place. In other instances, the flocking 160 is applied with the stator disconnected from the blower 100, i.e., the stator 148 receives flocking 160 with the stator 148 removed from its final operational position.

The combination of flocking 152 and 160 can reduce noise emission from the blower 100. It has been discovered that application of flocking materials does not decrease blower performance while allowing for reduction of at least 1 dB of sound emission.

Figure 6:
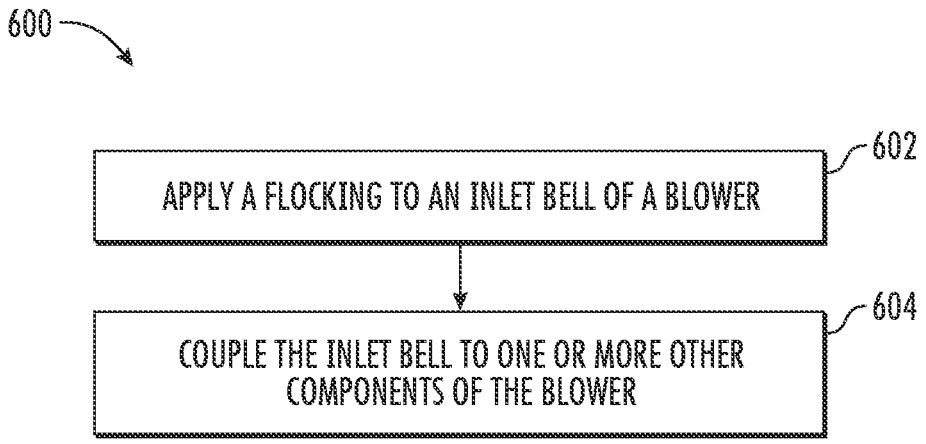
FIG. 6 is a flow chart of a method of sound dampening a blower in accordance with an exemplary embodiment of the present disclosure.

FIG. 6 depicts a flowchart of a method 600 of sound dampening a blower. The method 600 includes a step 602 of applying a flocking to an inlet bell of a blower. The method 600 further includes a step 604 of coupling the inlet bell to one or more other components of the blower. In some instances, step 602 is performed before step 604. That is, the flocking is applied to the inlet bell prior to coupling the inlet bell to one or more other components of the blower. The step 602 of applying the flocking can include loose fiber application as described above, adhering a sheet or strip of material to the inlet bell, or the like. In some instances, step 602 is performed in a single step. In other instances, step 602 is performed in a series of steps. For example, application of the flocking at step 602 can require a first step of preparing the inner surface of the inlet bell for flocking and then applying the flocking to the previously prepared inner surface. Preparation of the inner surface may include cleaning or finishing the inner surface with one or more finishing processes followed by application of adhesive to the inner surface. With adhesive in position, the flocking can be introduced as loose fibers, or semi-loose fibers. The fibers may be, but are not necessarily, trimmed to a desired length after application along the inlet bell. In some instances, trimming can result in a uniform length distribution of fibers across the surface of the inlet bell. In other instances, trimming can create zones of different flocking. For example, a first portion of the inlet bell can have a first flocking concentration or a first flocking length and a second portion of the inlet bell can have a second flocking concentration or a second flocking length different from the first flocking length.

In an embodiment, the step 604 of coupling the inlet bell to one or more other components can include coupling the inlet bell to at least one of an outlet tube disposed downstream of the inlet bell, a handle assembly, an inlet structure disposed upstream of the inlet bell, a grate disposed upstream of the inlet bell, a vibration isolation element, or the like.

Further aspects of the invention are provided by one or more of the following embodiments:

Embodiment 1. A blower comprising: an air inlet; an air outlet; an inlet bell disposed between the air inlet and the air outlet; an axial fan disposed at least partially within the inlet bell; and a fan stator disposed in series with the axial fan; wherein: the inlet bell comprises a first flocking disposed along an inner surface of the inlet bell at a location adjacent to a blade tip of the axial fan, wherein at least one stator blade of the fan stator comprises a second flocking disposed along an exposed surface of the least one stator blade, or both.

Embodiment 2. The blower of any one or more of the embodiments, wherein the first flocking comprises an adhesive backed tape.

Embodiment 3. The blower of any one or more of the embodiments, wherein the first flocking comprises loose fibers coupled to the inlet bell by an adhesive.

Embodiment 4. The blower of any one or more of the embodiments, wherein the loose fibers define an average angle, as measured with respect to a central axis of the inlet bell, and wherein the average angle is less during and after use of the blower as compared to the average angle measured prior to a first use of the blower.

Embodiment 5. The blower of any one or more of the embodiments, wherein the blade tip and an innermost surface of the inlet bell are separated by a first blade tip gap, $G_1$, wherein the blade tip and an innermost location of the first flocking are separated by a second blade tip gap, $G_2$, and wherein $G_1$ is at least 1.1 $G_2$.

Embodiment 6. The blower of any one or more of the embodiments, wherein $G_2$ is less than 0.25 mm.

Embodiment 7. The blower of any one or more of the embodiments, wherein the first flocking is disposed continuously along the inlet bell between the air inlet and a downstream side of the axial fan.

Embodiment 8. The blower of any one or more of the embodiments, wherein the axial fan comprises an axial fan assembly including a plurality of axial fans arranged in series, and wherein the first flocking is disposed downstream of a final axial fan of the plurality of axial fans.

Embodiment 9. A conduit for a blower, the conduit comprising: an inlet bell; a flocking disposed along at least a majority of an inner surface of the inlet bell.

Embodiment 10. The conduit of any one or more of the embodiments, wherein the conduit receives an axial fan such that at least one blade tip of the axial fan is spaced apart from the flocking by a fan tip clearance gap of less than 1 mm.

Embodiment 11. The conduit of any one or more of the embodiments, wherein the flocking is disposed continuously along the entire inner surface of the inlet bell.

Embodiment 12. The conduit of any one or more of the embodiments, wherein the flocking is coupled to the inlet bell by an adhesive.

Embodiment 13. The conduit of any one or more of the embodiments, wherein the flocking comprises loose fibers coupled to the conduit by an adhesive.

Embodiment 14. The conduit of any one or more of the embodiments, wherein the conduit further comprises a plurality of stator blades, and wherein the stator blades are covered by the flocking.

Embodiment 15. The conduit of any one or more of the embodiments, wherein the flocking has a thickness of less than 2 mm.

Embodiment 16. A method of sound dampening a blower, the method comprising: applying a flocking to an inlet bell of the blower; and coupling the inlet bell to one or more other components of the blower.

Embodiment 17. The method of any one or more of the embodiments, wherein applying the flocking is performed by distributing loose flock fibers along an inner surface of the inlet bell and adhering the loose flock fibers to the inner surface using an adhesive.

Embodiment 18. The method of any one or more of the embodiments, wherein applying the flocking is performed by removing a backing from a tape to expose an adhesive, and adhering the tape to an inner surface of the inlet bell using the adhesive.

Embodiment 19. The method of any one or more of the embodiments, wherein the method further comprises applying the flocking to a stator blade of the blower, wherein the stator blade extends between sections of an inner surface of the inlet bell.

Embodiment 20. The method of any one or more of the embodiments, wherein coupling the inlet bell to one or more other components comprises coupling the inlet bell to at least one of an outlet tube disposed downstream of the inlet bell, a handle assembly, an inlet structure disposed upstream of the inlet bell, a grate disposed upstream of the inlet bell, a vibration isolation element, or the like.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A blower comprising:

a housing;

an air inlet;

an air outlet;

an inlet bell disposed between the air inlet and the air outlet;

an axial fan disposed at least partially within the inlet bell;

a fan stator coupling the axial fan to the housing;

a first flocking disposed along an inner surface of the inlet bell at a location adjacent to a blade tip of the axial fan, wherein the first flocking comprises loose fibers coupled to the inlet bell by an adhesive or wherein the first flocking comprises an adhesive backed tape;

a handle extending from a location in front of the air inlet to a location behind the air inlet; and a battery coupled to the handle at a location behind the air inlet.

2. The blower of claim 1, wherein the flocking covers the entire inner surface of the inlet bell.

3. The blower of claim 1, wherein at least one stator blade of the fan stator comprises a second flocking disposed along an exposed surface of the at least one stator blade.

4. The blower of claim 1, wherein the axial fan is coupled to the inlet bell through the fan stator.

5. The blower of claim 1, wherein the blade tip and an innermost surface of the inlet bell are separated by a first blade tip gap, $G_1$, wherein the blade tip and an innermost location of the first flocking are separated by a second blade tip gap, $G_2$, and wherein $G_1$ is at least 1.1 $G_2$.

6. The blower of claim 1, wherein the inlet bell defines a body thickness $T_B$, wherein the first flocking defines a flocking thickness, $T_F$, and wherein a thickness ratio of $T_F/T_B$ is less than 0.5.

7. The blower of claim 1, wherein the blower defines a central axis extending between the air inlet and the air outlet, and wherein the handle lies along a line offset from the central axis by no greater than 10 degrees.

8. A blower comprising:

a housing;

an air inlet;

an air outlet;

an inlet bell disposed between the air inlet and the air outlet;

an axial fan disposed at least partially within the inlet bell;

a fan stator coupling the axial fan to the housing;

a first flocking disposed along an inner surface of the inlet bell at a location adjacent to a blade tip of the axial fan, wherein the first flocking comprises loose fibers coupled to the inlet bell by an adhesive or wherein the first flocking comprises an adhesive backed tape, wherein the inlet bell defines a body thickness $T_B$, wherein the first flocking defines a flocking thickness, $T_F$, and wherein a thickness ratio of $T_F/T_B$ is less than 0.9.

9. The blower of claim 8, wherein the thickness ratio of $T_F/T_B$ is less than 0.5.

10. The blower of claim 8, wherein the flocking covers the entire inner surface of the inlet bell.

11. The blower of claim 8, wherein at least one stator blade of the fan stator comprises a second flocking disposed along an exposed surface of the at least one stator blade.

12. The blower of claim 8, wherein the blade tip and an innermost surface of the inlet bell are separated by a first blade tip gap, $G_1$, wherein the blade tip and an innermost location of the first flocking are separated by a second blade tip gap, $G_2$, and wherein $G_1$ is at least 1.1 $G_2$.

13. The blower of claim 8, further comprising:

a handle extending from a location in front of the air inlet to a location behind the air inlet; and a battery coupled to the handle at a location behind the air inlet, wherein the blower defines a central axis, and wherein the handle lies along a line offset from the central axis by no greater than 10 degrees.

14. The blower of claim 8, wherein the flocking has a non-uniform flocking distribution along the inner surface of the inlet bell.

15. A method of sound dampening a blower, the method comprising:

applying a flocking to an inlet bell of the blower at a location adjacent to a blade tip of an axial fan of the blower, wherein the inlet bell defines a body thickness $T_B$, wherein the first flocking defines a flocking thickness, $T_F$, and wherein a thickness ratio of $T_F/T_B$ is less than 0.9; and coupling the inlet bell to a housing of the blower between an air inlet and an air outlet of the blower, wherein the axial fan is coupled to the inlet bell, wherein applying the flocking is performed by distributing loose flock fibers along an inner surface of the inlet bell and adhering the loose flock fibers to the inner surface using an adhesive or wherein applying the flocking is performed by removing a backing from a tape to expose an adhesive and adhering the tape to an inner surface of the inlet bell using the adhesive.

16. The method of claim 15, wherein applying the flocking is performed such that the flocking covers the entire inner surface of the inlet bell.

17. The method of claim 15, wherein applying the flocking is performed such that the flocking has a non-uniform flocking distribution along the inner surface of the inlet bell.

18. The method of claim 15, wherein the method further comprises applying the flocking to a stator blade of the blower, wherein the stator blade extends between sections of an inner surface of the inlet bell.

19. The method of claim 15, wherein coupling the inlet bell to one or more secondary components comprises coupling the inlet bell to at least one of an outlet tube disposed downstream of the inlet bell, a handle assembly, an inlet structure disposed upstream of the inlet bell, a grate disposed upstream of the inlet bell, or a vibration isolation element.

20. The method of claim 15, wherein applying the flocking is performed by circularly wrapping an adhesive backed tape around the inlet bell.

* * * * *